US008665181B2

(12) United States Patent
Lee et al.

(10) Patent No.: US 8,665,181 B2
(45) Date of Patent: Mar. 4, 2014

(54) METHOD FOR DRIVING AN AC TYPE PLASMA DISPLAY PANEL

(75) Inventors: Hwan Woo Lee, Gumi-si (KR); Gap Sik Park, Daegu (KR)

(73) Assignee: Orion Co., Ltd., Gyeongsangbuk-do (KR)

( * ) Notice: Subject to any disclaimer, the term of this patent is extended or adjusted under 35 U.S.C. 154(b) by 316 days.

(21) Appl. No.: 13/121,536

(22) PCT Filed: Sep. 30, 2009

(86) PCT No.: PCT/KR2009/005597

§ 371 (c)(1),
(2), (4) Date: Mar. 29, 2011

(87) PCT Pub. No.: WO2010/038981

PCT Pub. Date: Apr. 8, 2010

(65) Prior Publication Data

US 2011/0175889 A1 Jul. 21, 2011

(30) Foreign Application Priority Data

Oct. 1, 2008 (KR) ..... 10-2008-0096455

(51) Int. Cl.
*G09G 3/28* (2013.01)

(52) U.S. Cl.
USPC ..... 345/67; 345/60; 345/61; 345/208; 345/211; 315/169.1; 315/169.4

(58) Field of Classification Search
USPC ..... 345/60–73, 211, 37, 41, 204–205, 208; 315/169.4, 169.1
See application file for complete search history.

(56) References Cited

U.S. PATENT DOCUMENTS

| | | | | |
|---|---|---|---|---|
| 2002/0041161 | A1 | 4/2002 | Setoguchi et al. | |
| 2003/0030599 | A1 * | 2/2003 | Kim | 345/60 |
| 2006/0097964 | A1 * | 5/2006 | Moon | 345/68 |
| 2006/0232508 | A1 | 10/2006 | Furukawa et al. | |
| 2007/0216605 | A1 | 9/2007 | Kong et al. | |

* cited by examiner

*Primary Examiner* — Lun-Yi Lao
*Assistant Examiner* — MD Saiful A Siddiqui
(74) *Attorney, Agent, or Firm* — Head, Johnson & Kachigian, P.C.

(57) ABSTRACT

This disclosure relates to a method for driving an AC type plasma display panel. According to this disclosure, an elapse time period between an end time point of ramp-down and a time when a first scan pulse is applied is maintained to be uniform even when a ramp-down slope is different in such a manner that a comparator of a scan electrode driving circuit compares an output voltage with a reference voltage and a logic control circuit outputs a control signal to a logic control circuit when the output voltage is equal to the reference voltage. Accordingly, the method for driving the AC type plasma display panel is capable of improving an address characteristic and a driving margin.

3 Claims, 6 Drawing Sheets

METHOD FOR DRIVING AN AC TYPE PLASMA DISPLAY PANEL

TECHNICAL FIELD

This disclosure relates to a method for driving an AC type plasma display panel, and more particularly, to a method for driving an AC type plasma display panel capable of improving an address characteristic and a driving margin even when a ramp-down slope is different in a ramp-down discharge period.

BACKGROUND ART

In general, an AC type plasma display panel is a display element which exhibits luminance by generating a gas discharge inside cells. The plasma display panel is classified into an AC type and a DC type in accordance with a discharge type. As the AC-type plasma display panel, an AC three-electrode surface discharge plasma display panel having three electrodes is widely used.

The general AC three-electrode surface discharge plasma display panel controls luminance by inducing a reliable discharge of a cell in accordance with a voltage applied from the outside of the cell. In a driving waveform of such a plasma display panel, an address display separation (ADS) driving type with ramp-reset is used. In the ADS driving type, in order to realize one image, one frame is divided into plural subfields having different number of sustain pulses, and each of the subfields is divided into three periods, that is, a reset period, an address period, and a sustain period. The reset period is a period during which a uniform wall charge suitable for discharge conditions of all cells of the plasma display panel with respect to an external application voltage is adjusted to be maintained in order to induce a stable address discharge in the address period. The address period is a period during which a cell to be discharged or not to be discharged in the sustain period is divided in such a manner that all cells are subjected to an address discharge by sequentially applying a scan pulse to numerous scan electrodes Y and applying a data voltage Vd to the address electrode A. At this time, the wall charge of the cell to be discharged changes greatly, and hence a condition is satisfied in which the sustain discharge is maintained in the sustain period. The sustain period is a period during which the sustain discharge of the cell selected as the cell to be discharged in the address period is continued by alternately applying the high sustain voltage Vsus to the scan electrode Y and the sustain electrode X.

FIG. 1 is a waveform diagram showing a general driving waveform of an AC type plasma display panel, and FIG. 2 is a circuit diagram showing a switching circuit of a general scan electrode driving circuit for realizing a scan electrode driving waveform.

The operations of the reset period, the address period, and the sustain period will be described with reference to FIGS. 1 and 2. First, in the reset period, a ground (GND) voltage is applied as the driving voltage of scan electrode so that fourth, fifth, and sixth switches SW4, SW5, and SW6 and eleventh and thirteenth switches SW11 and SW13 (SC2) of a switching circuit 20 in a scan electrode driving circuit (not shown) are turned on. Subsequently, in a ramp-up period, in order to increase the ground voltage up to the sustain voltage Vsus, the fourth switch SW4 is turned off and the first and third switches SW1 and SW3 are sequentially turned on. Subsequently, in order to increase the sustain voltage Vsus up to a voltage Vyr with a slope, the fifth switch SW5 is turned off and the seventh switch SW7 is turned on so as to operate a ramp-up switch, thereby generating a voltage waveform having a slope. Subsequently, in order to decrease the voltage Vyr down to the sustain voltage Vsus again, the seventh switch SW7 is turned off and the fifth switch SW5 is turned on so as to output the sustain voltage Vsus to the scan electrode Y. Subsequently, in a ramp-down period, the sixth switch SW6 is turned off and the eighth switch SW8 is turned on so as to gradually decrease down to the scan voltage Vsc.

Subsequently, in the address period, the eleventh and thirteenth switches SW11 and SW13 (SC2) are turned off, the tenth and twelfth switches SW10 and SW12 (SC1) are turned on so as to apply the voltage Vyl (the voltage at the point D in FIG. 2) to all cells in a panel (not shown), and the ninth switch SW9 is turned on. At a scan IC, a voltage Vcc is the voltage Vyl (the voltage at the point D in FIG. 2), and the ground voltage becomes the scan voltage Vsc through the point C in FIG. 2 and the eighth switch SW8 as the ramp-down element, which forms a more reliable path compared with the case of the address discharge. Subsequently, when the scan IC is driven, one of the voltage at the point C, which is the ground voltage of the scan IC, and the voltage at the point D, which is Vcc, is selected.

Subsequently, in the sustain period, the sustain voltage Vsus and the ground (GND) voltage of 0 V are sequentially applied so as to output the sustain voltage Vsus to the scan electrode Y through the third, fifth, sixth, and thirteenth switches SW3, SW5, SW6, and SW13 and to electrically connect the ground (GND) voltage to the scan electrode Y through the fourth, fifth, sixth, and thirteenth switches SW4, SW5, SW6, and SW13. Here, the first and second switches SW1 and SW2 are temporarily turned on and off at the time points at which the sustain voltage Vsus is applied, increased, and decreased so that the non-discharge power supplied to the panel is recovered and supplied to the circuit again. Accordingly, the first and second switches SW1 and SW2 are used as a circuit of energy recovery for improving the energy consumption.

In general, in a mass production of the AC type plasma display panel, the panel exhibits various characteristics, and the ramp-down slope shown in FIG. 1 needs to be changed in some cases. In the foregoing description, at the time point when the ramp-down period ends, the voltage Vyl shown in FIG. 1 and the voltage Vcc of the scan IC at the point D in FIG. 2 are applied to all cells. At this time, the eleventh and thirteenth switches SW11 and SW13 (SC2) are turned off, and the tenth and twelfth switches SW10 and SW12 (SC1) are turned on. Such a switching is controlled by a logic control circuit (not shown).

Accordingly, the output of the scan electrode may be shown as FIGS. 3*a*, 3*b*, and 3*c* in accordance with the ramp-down slope. That is, the first, second, third elapse time periods t1, t2, and t3 between the end time point of ramp-down discharge t0 and the time when a first scan pulse is applied are different from each other. In the case of FIG. 3*c*, since the third elapse time period t3 is longer than those of the first and second elapse time periods t1 and t2, priming particles created by the ramp-down discharge gradually vanish. Subsequently, the amount of the priming particles to be used in the address discharge decreases, which is disadvantageous in the address discharge.

In order to avoid the disadvantage, another method for driving the AC type plasma display panel has been proposed. The driving method will be described with reference to FIGS. 2, 4, and 5. A comparator 41 in a scan electrode driving circuit 40 compares an output voltage Y3 of the scan electrode when a scan voltage Y2 of a switching circuit 20 in the scan electrode driving circuit 40 is ramped down to a reference voltage Vsc. When the ramp-down is continued and the output voltage Y3 of the scan electrode is equal to the scan voltage Y2, the comparator 41 compares the output voltage Y3 with the scan voltage Y2, and uses the output signal as the control signal for controlling the tenth, eleventh, twelfth, and thirteenth switches 10, 11, 12, and 13 SW10, SW11, SW12, and SW13. Accordingly, the eleventh and thirteenth switches SW11 and SW13 are turned off, and the tenth and twelfth switches SW10 and SW12 are turned on so as to apply the voltage Vyl in FIG. 1 to all cells in the panel.

The output waveform of the scan electrode in this case is shown in FIG. 5. When the voltage of the scan electrode is changed in the positive direction faster as compared to the end time point of ramp-down discharge, some of negatively charged particles among the charged priming particles move toward the scan electrode, and some of positively charged particles move toward the sustain electrode or the address electrode during the ramp-down discharge. Subsequently, since the scan electrode is used as the negative electrode and the sustain electrode and the address electrode are used as the positive electrode upon performing the address discharge, the movement of the particles is advantageous in the address discharge. However, even when the voltage Vyl is promptly applied in accordance with a variation in the ramp-down slope, since the first, second, and third elapse time periods t11, t12, and t13 between the end time point of ramp-down t0 and the time when a first scan pulse is applied are different from each other as shown in FIGS. 5*a*, 5*b*, and 5*c*, but since the time when a first scan pulse is applied are constant as seen in FIGS. 3*a*, 3*b*, and 3*c*, the priming particles remaining in space inevitably vanish except for the particles formed by the wall charge during the elapse time period until the time when a first scan pulse is applied. Accordingly, in the cases of FIGS. 5*b* and 5*c*, as described in the case of FIG. 3*c*, the amount of the priming particles used in the address discharge decreases, which is disadvantageous in the address discharge.

As described, in the address period, since the conditions such as the amount of the priming particles or the formation of the wall charge caused by the discharge in the preceding reset period largely influence the discharge condition in the address period, it is necessary to further smoothly generate the address discharge by maximally utilizing the priming particles when performing the address discharge.

DISCLOSURE OF INVENTION

Technical Problem

Therefore, this disclosure is directed to providing a method for driving an AC type plasma display panel capable of improving an address discharge characteristic in such a manner that priming particles and a wall charge created by a discharge in a reset period are maximally utilized in a discharge in an address period.

The disclosure is also directed to providing a method for driving an AC type plasma display panel capable of improving a driving margin in such a manner that priming particles and a wall charge created by a discharge in a reset period are maximally utilized in a discharge in an address period.

Solution to Problem

Disclosed herein is a method for driving an AC type plasma display panel having a three-electrode structure in which one frame is divided into plural subfields, each of the plural subfields is divided into a reset period, an address period, and a sustain period, and all periods of the last subfield end within a time of one frame, the method for driving the AC type plasma display panel including: allowing a comparator of a scan electrode driving circuit to compare a reference voltage with an output voltage in a ramp-down discharge period of a scan electrode; allowing the comparator to output a control signal when the output voltage arrives at the reference voltage; allowing the scan electrode driving circuit to apply a predetermined voltage Vyl to all cells in response to the control signal; and allowing a logic control circuit, according to the control signal, to maintain an elapse time between a time point when the predetermined voltage Vyl is applied to all cells and a time point when the address period starts to be uniform even when a scan pulse is applied.

A scan voltage Vsc or a voltage larger than the scan voltage Vsc by V may be used as the reference voltage.

Advantageous Effects of Invention

According to this disclosure, it is possible to improve the address characteristic and the driving margin by maintaining the elapse time period between the end time point of ramp-down to time when a first scan pulse is applied to be uniform even when the ramp-down slope is different in such a manner that a comparator of a scan electrode driver compares an output voltage Y3 with a reference voltage Y2 in the ramp-down discharge period and a logic control circuit outputs a control signal when the voltage values are equal to each other.

BRIEF DESCRIPTION OF DRAWINGS

The above and other aspects, features and advantages of the disclosed exemplary embodiments will be more apparent from the following detailed description taken in conjunction with the accompanying drawings in which.

BEST MODE FOR CARRYING OUT THE INVENTION

Figure 1:
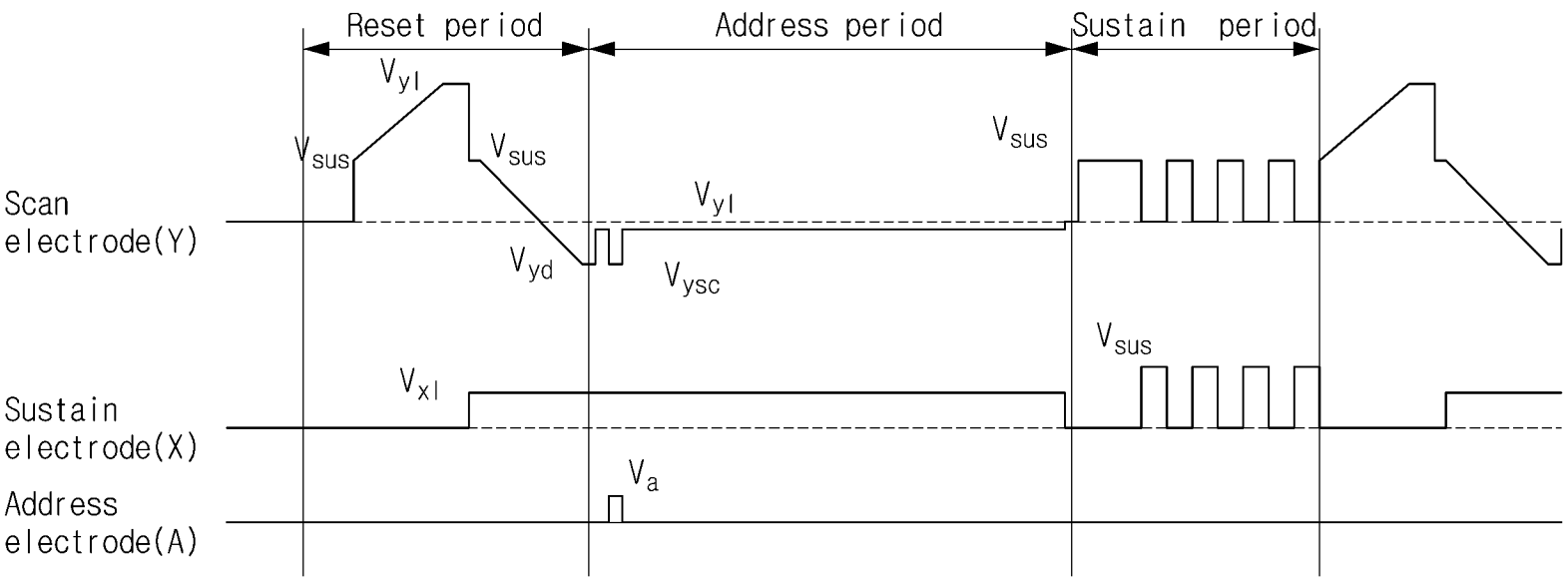
FIG. 1 (PRIOR ART)
FIG. 1 is a waveform diagram showing a general driving waveform of an AC type plasma display panel.

Exemplary embodiments now will be described more fully hereinafter with reference to the accompanying drawings, in which exemplary embodiments are shown. This disclosure may, however, be embodied in many different forms and should not be construed as limited to the exemplary embodiments set forth therein. Rather, these exemplary embodiments are provided so that this disclosure will be thorough and complete, and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second" and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals in the drawings denote like elements. The shape, size and regions, and the like, of the drawing may be exaggerated for clarity.

Figure 6:
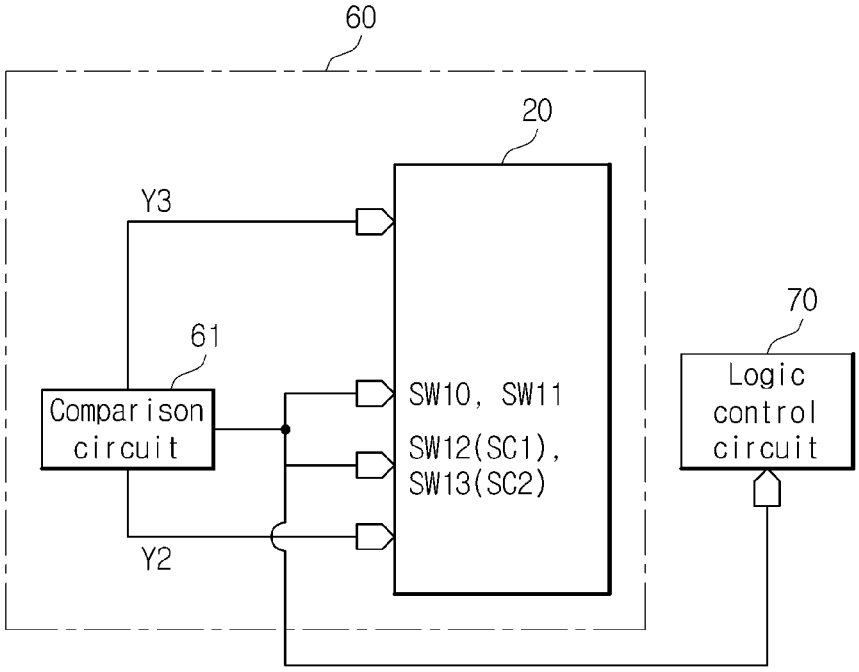
FIG. 6 is a block diagram schematically showing a main part of a scan electrode driving circuit applied to the method for driving the AC type plasma display panel according to an embodiment of present disclosure.

FIG. 6 is a block diagram schematically showing a main part of a scan electrode driving circuit applied to a method for driving an AC type plasma display panel according to an embodiment of present disclosure.

Referring to FIG. 6, a driving circuit for driving an AC type plasma display panel includes a scan electrode driving circuit 60, a logic control circuit 70, a sustain electrode driving circuit (not shown), an address electrode driving circuit (not shown), and a power supply circuit (not shown).

Figure 2:
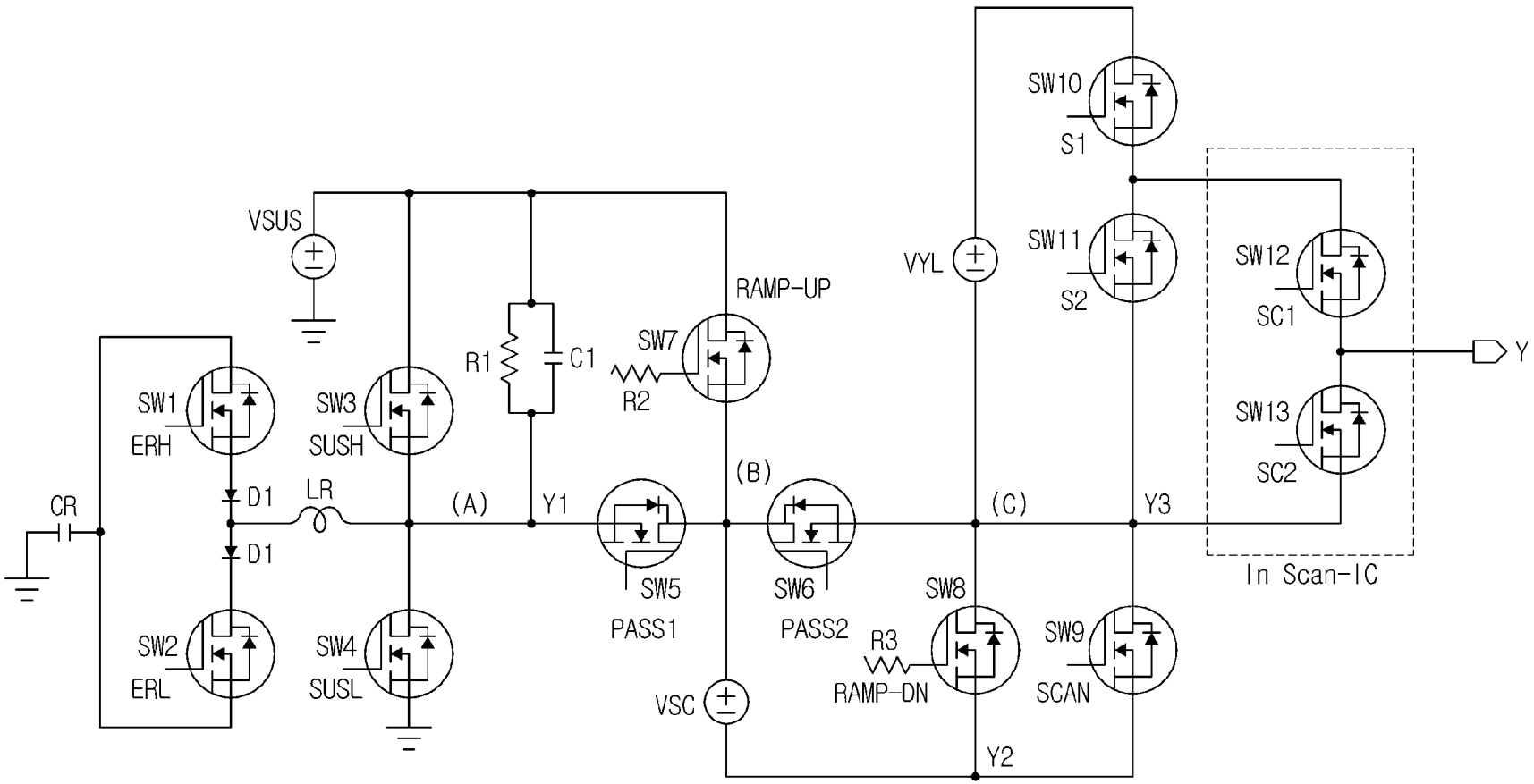
FIG. 2 (PRIOR ART)
FIG. 2 is a circuit diagram showing a switching circuit of a general scan electrode driving circuit for realizing a scan electrode driving waveform.

The scan electrode driving circuit 60 includes a comparator 61 and a switching circuit 20 having a structure shown in FIG. 2. The comparator 61 compares an output voltage Y3 of the switching circuit 20 with a reference voltage Y2. The comparison result as an output signal controls tenth and eleventh switches SW10 and SW11 of the switching circuit 20 and twelfth and thirteenth switches SW12 (SC1) and SW13 (SC1) of a scan IC, and simultaneously is input to the logic control circuit 70.

The logic control circuit 70 generates a control signal for controlling the driving circuit, the scan IC, and a data IC. In order to solve the problems in the prior art, the output time points of the control signals for outputting the waveforms in respective periods are reset in advance.

Figure 7:
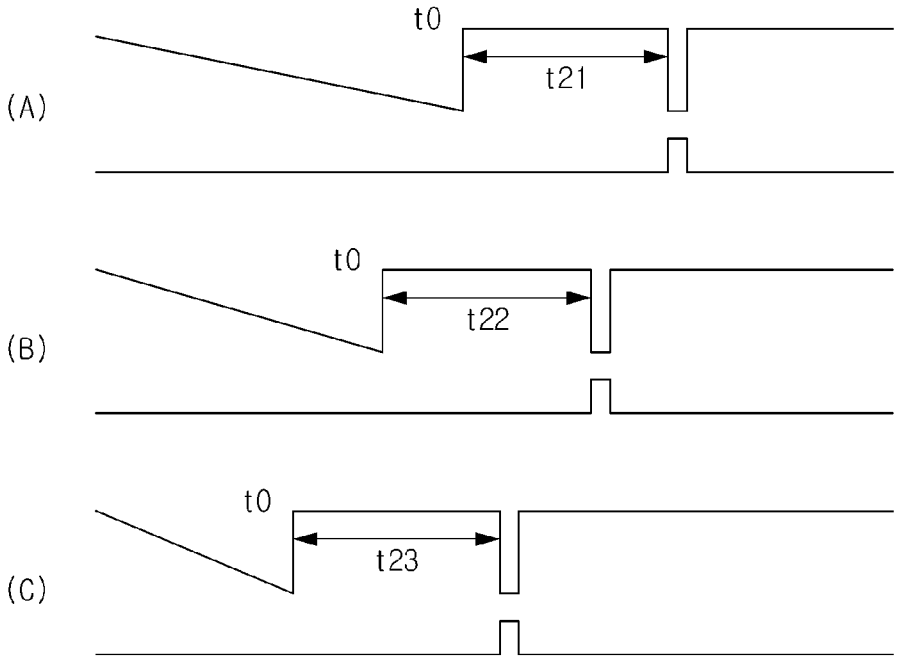
FIGS. 7*a*, 7*b*, and 7*c* are waveform diagrams showing driving waveforms in the method for driving the AC type plasma display panel according to an embodiment of present disclosure, where the elapse time periods between an end time point of ramp-down discharge and a time when a first scan pulse is applied are maintained to be constant even with different ramp-down slopes.

Referring to FIG. 7, the method for driving the AC type plasma display panel according to present disclosure will be described by using the driving circuit having the above-described configuration.

First, when a scan electrode voltage is in a ramp-down state in a reset period, a comparator 61 of a scan electrode driving circuit 60 compares a reference voltage Y2 with an output voltage Y3 of a switching circuit 20. During the ramp-down state, the comparator 61 continuously compares the reference voltage Y2 with the output voltage Y3. When the output voltage Y3 is equal to the reference voltage Y2, the comparator 61 generates the result as a corresponding signal, and inputs the corresponding signal to tenth, eleventh, twelfth, and thirteenth switches SW10, SW11, SW12, and SW13. By the control of the corresponding signal which is input, the eleventh and thirteenth switches SW11 and SW 13 are turned off, and the tenth and twelfth switches SW10 and SW12 are turned on. In such a state, a voltage Vyl shown in FIG. 1 is applied to all cells of a panel (not shown), and a ramp-down discharge ends.

When the output voltage Y3 is equal to the reference voltage Y2, the comparator 61 simultaneously inputs the corresponding signal to a logic control circuit 70. Accordingly, the logic control circuit 70 resets the output time point of the control signal for controlling a driving circuit, a scan IC, and a data IC in order to generate an address discharge. In detail, the ramp-down slopes are set differently in FIGS. 7*a*, 7*b*, and 7*c*. That is, the ramp-down slope shown in FIG. 7*a* is gentler than those shown in FIGS. 7*b* and 7*c*. In FIGS. 7*a*, 7*b*, and 7*c*, the ramp-down is output in accordance with the respective ramp-down slopes. In the case of FIG. 7*c*, the comparator 61 outputs the corresponding signal at the earliest time point. Subsequently, in a sequential order of FIGS. 7*b* and 7*a*, the comparator 61 outputs the corresponding signal. Accordingly, the corresponding signal created by the comparator 61 is used to control the tenth and eleventh switches SW10 and SW11 and the twelfth and thirteenth switches SW12 (SC1) and SW13 (SC2) shown in FIG. 2, so that the eleventh and thirteenth switches SW11 and SW13 are turned off and the tenth and twelfth switches SW10 and SW 12 are turned on. Thus, the voltage Vyl is applied to all cells of the panel. The application time point is the earliest in the case of FIG. 7*c*. And, the application time point in FIG. 7*b* is earlier than that in FIG. 7*a*.

The corresponding signal created by the comparator 61 is input to the logic control circuit 70 as shown in FIG. 6. The logic control circuit 70 resets differently the output time points of the control signals set in advance for the driving circuit, the scan IC, and the data IC so as to promptly generate an address discharge upon receiving the corresponding signal from the comparator 61.

Figure 3:
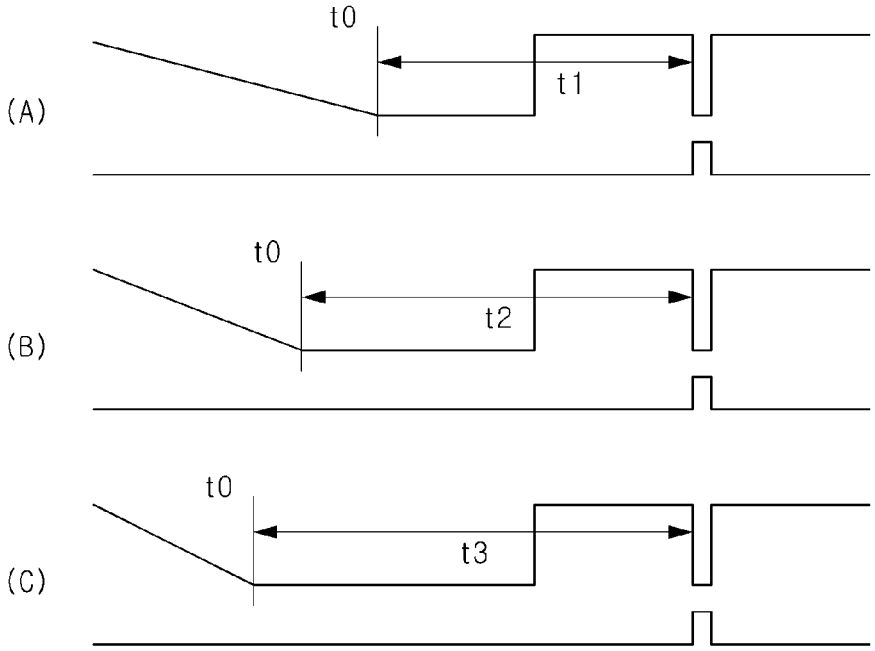
FIG. 3 (PRIOR ART)
FIG. 3 is a waveform diagram showing a driving waveform in a method for driving an AC type plasma display panel according to a prior art, where the elapse time periods between an end time point of ramp-down discharge and a time when a first scan pulse is applied are different due to different ramp-down slopes.
Figure 4:
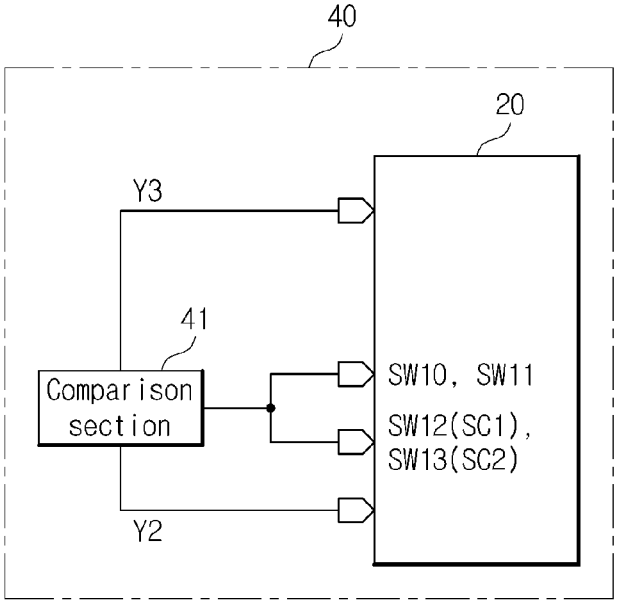
FIG. 4 (PRIOR ART)
FIG. 4 is a block diagram schematically showing a scan electrode driving circuit applied to another method for driving an AC type plasma display panel according to a prior art.
Figure 5:
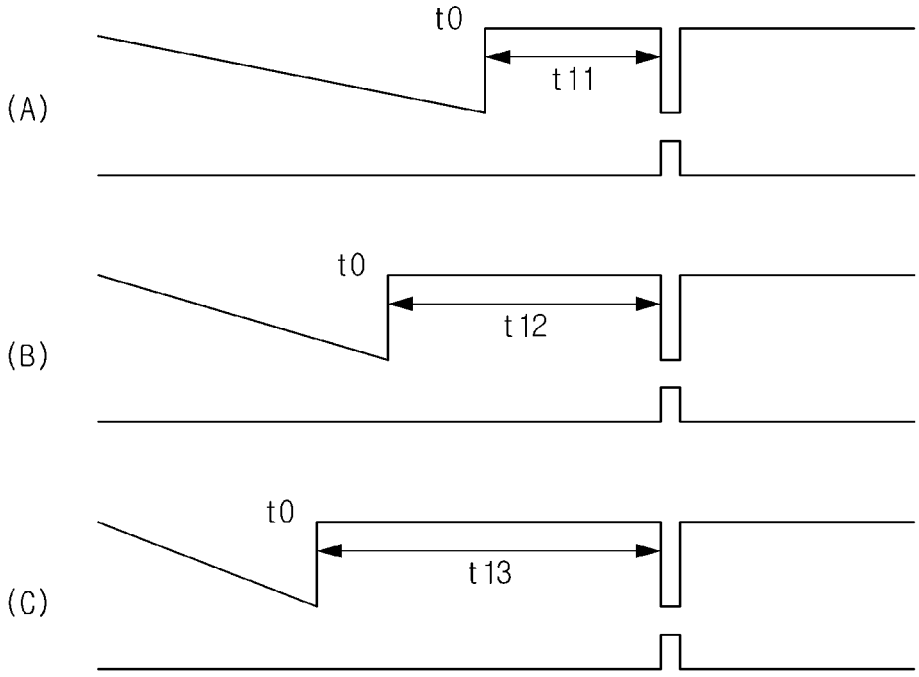
FIG. 5 (PRIOR ART)
FIGS. 5*a*, 5*b*, and 5*c* are waveform diagrams showing driving waveforms in another method for driving an AC type plasma display panel according to a prior art, where the elapse time periods between an end time point of ramp-down discharge and a time when a first scan pulse is applied are different due to different ramp-down slopes.

In the prior art, as in the waveforms shown in FIGS. 3 and 5, the time point of address did not change even when the ramp-down slope changed. However, in present disclosure, as shown in FIG. 7, the control signal output from the comparator 61 is more promptly generated as the ramp-down slope is larger. And, when the control signal is generated, the time point when a first scan pulse is applied becomes earlier. That is, the time when a first scan pulse is applied is the earliest in the case of FIG. 7*c* in which the ramp-down slope is the largest, and the time when a first scan pulse is applied in FIG. 7*b* is earlier than that in FIG. 7*a*. Accordingly, although the end time points of ramp-down t0 are different, the first, second, third elapse time periods t21, t22, and t23 between the end time point of ramp-down and the time when a first scan pulse is applied are equal to each other.

Thus, according to this disclosure, since it is possible to promptly perform the address operation after the ramp-down discharge as described above, it is possible to start the address operation by sufficiently utilizing the priming particles created by the ramp-down discharge. Accordingly, since the address discharge becomes more stable due to the priming effect, it is possible to improve the driving margin by preventing such phenomenon as vanishing caused by an error in the addressing.

Figure 8:
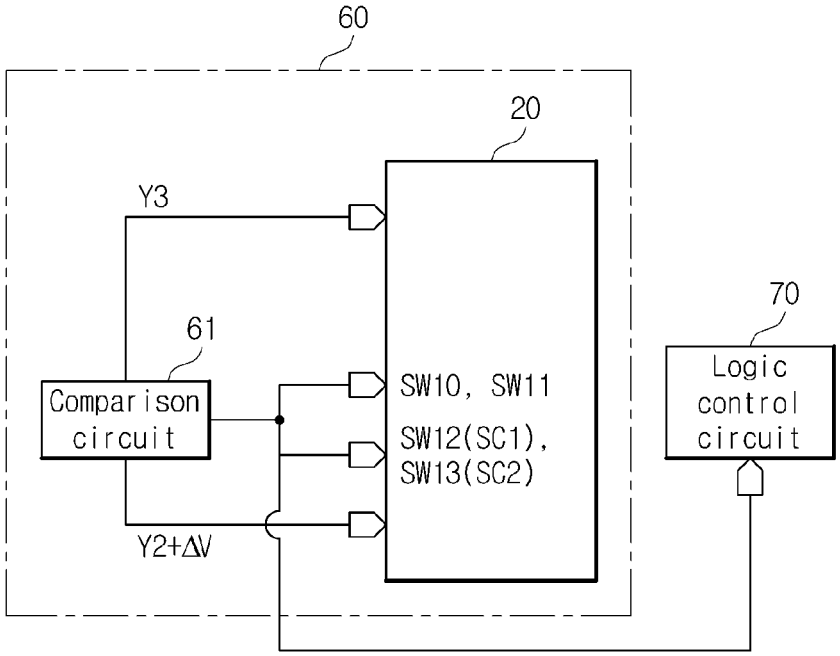
FIG. 8 is a block diagram schematically showing a main part of the scan electrode driving circuit applied to the method for driving the AC type plasma display panel according to another embodiment of present disclosure.

FIG. 8 shows a driving circuit which is applied to a method for driving an AC type plasma display panel according to another embodiment of present disclosure. FIGS. 9*a*, 9*b*, and 9*c* show the driving waveform which is applied to the driving circuit shown in FIG. 8.

The driving circuit shown in FIG. 8 has the same configuration as that of the driving circuit shown in FIG. 7 except that the reference voltage input to the comparator 61 is set to a voltage Y2+V instead of the voltage Y2 (Vsc).

Figure 9:
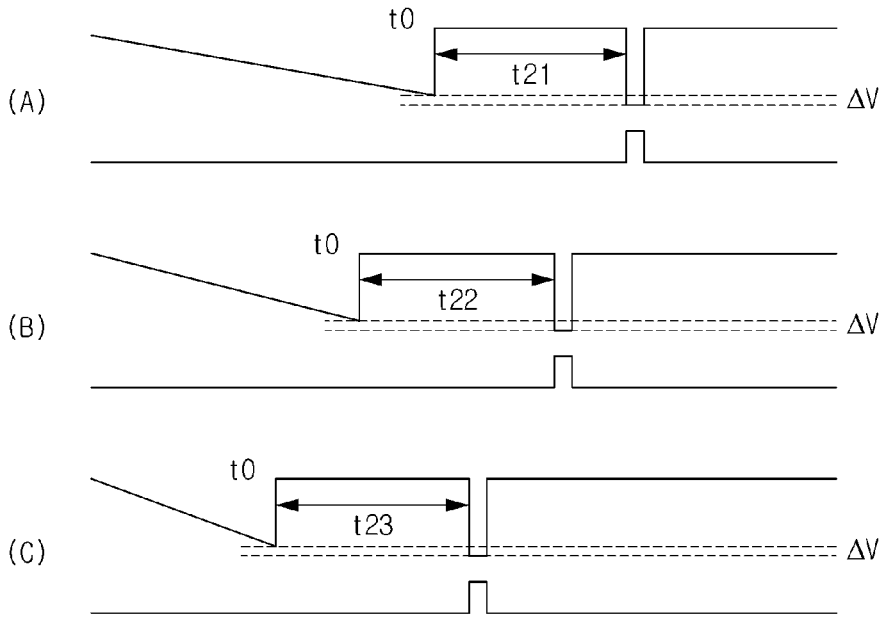
FIGS. 9*a*, 9*b*, and 9*c* are waveform diagrams showing driving waveforms in the method for driving the AC type plasma display panel according to another embodiment of present disclosure, where the elapse time periods between an end time point of ramp-down discharge and a time when a first scan pulse is applied are maintained to be constant even with different ramp-down slopes.

In the driving circuit having such a configuration, as shown in FIG. 9, the ramp-down discharge is performed down to the voltage Vsc+V instead of the voltage Vsc, and the scan pulse applied to the scan electrode is decreased down to the voltage Vsc at the address discharge time point. Accordingly, since the voltage V is further applied to the scan electrode at the address discharge time point compared with FIG. 7, it is possible to induce a smoother and more stable address discharge, and to improve the driving margin. Since the other operations are the same as those described in FIGS. 6 and 7, the detailed description thereof will be omitted in order to avoid the repetitive description.

While the exemplary embodiments have been shown and described, it will be understood by those skilled in the art that various changes in form and details may be made thereto without departing from the spirit and scope of this disclosure as defined by the appended claims.

In addition, many modifications can be made to adapt a particular situation or material to the teachings of this disclosure without departing from the essential scope thereof. Therefore, it is intended that this disclosure not be limited to the particular exemplary embodiments disclosed as the best mode contemplated for carrying out this disclosure, but that this disclosure will include all embodiments falling within the scope of the appended claims.

The invention claimed is:

1. A method for driving an AC type plasma display panel having a three-electrode structure in which one frame is divided into plural subfields, each of the plural subfields is divided into a reset period, an address period, and a sustain period, and all periods of the last subfield end within a time of one frame, the method for driving the AC type plasma display panel comprising:

allowing a comparator of a scan electrode driving circuit to compare a reference voltage with an output voltage in a ramp-down discharge period of a scan electrode;

allowing the comparator to simultaneously output a control signal to both the scan electrode driving circuit and to a logic control circuit when the output voltage arrives at the reference voltage;

allowing the scan electrode driving circuit to apply a predetermined voltage Vyl to all cells in response to the control signal; and allowing the logic control circuit to differently set an output time point of the control signal in response to the control signal, to maintain an elapse time period to be uniform even when a ramp-down slope is different between a time point when the predetermined voltage Vyl is applied to all cells and a time point when the address period starts to be uniform even when a first scan pulse is applied.

2. The method for driving the AC type plasma display panel according to claim 1, wherein a scan voltage Vsc is used as the reference voltage.

3. The method for driving the AC type plasma display panel according to claim 1, wherein a voltage changed from a scan voltage Vsc by V (V being a voltage less than Vsc) is used as the reference voltage.

* * * * *